US008342352B2

(12) United States Patent
Alirol

(10) Patent No.: US 8,342,352 B2
(45) Date of Patent: Jan. 1, 2013

(54) LIQUID COVERING DISKS

(76) Inventor: Matt Alirol, The Dalles, OR (US)

( * ) Notice: Subject to any disclaimer, the term of this patent is extended or adjusted under 35 U.S.C. 154(b) by 254 days.

(21) Appl. No.: 12/877,948

(22) Filed: Sep. 8, 2010

(65) Prior Publication Data

US 2010/0326342 A1 Dec. 30, 2010

(51) Int. Cl.
*B65D 88/36* (2006.01)

(52) U.S. Cl. ..... 220/218; 114/267

(58) Field of Classification Search ..... 441/1; 114/264, 114/266, 267; 405/26; 220/218
See application file for complete search history.

(56) References Cited

U.S. PATENT DOCUMENTS

| | | | | |
|---|---|---|---|---|
| 3,299,846 | A * | 1/1967 | Jarlan | 114/264 |
| 3,938,338 | A | 2/1976 | Cullen | |
| 3,993,214 | A | 11/1976 | Usab | |
| 4,155,323 | A * | 5/1979 | Finsterwalder | 114/264 |
| 4,189,058 | A | 2/1980 | Seliskar et al. | |
| 8,099,804 | B2 * | 1/2012 | Gregg | 4/498 |

OTHER PUBLICATIONS

Hexa-Cover, "The Unique Floating Cover System", pp. 1-4, Thistead, Denmark.

* cited by examiner

*Primary Examiner* — Edwin Swinehart
(74) *Attorney, Agent, or Firm* — Mohr Intellectual Property Law Solutions, PC

(57) ABSTRACT

Disks configured to float on the surface of a body of liquid, including a top member configured to float substantially above the surface of the body of liquid, a bottom member spaced from the top member and configured to float substantially below the surface of the body of liquid, a sidewall extending between the top member and the bottom member along the periphery of the top member and along the periphery of the bottom member, wherein the top member, the bottom member, and the sidewall collectively define a cavity, a chamber mounted within the cavity, the chamber enclosing a predetermined volume of a gas, and a port defined in the sidewall to allow liquid from the body of liquid to enter the cavity, wherein the predetermined volume of gas enclosed in the chamber is selected to impart a buoyancy force sufficient to maintain the disk afloat on the body of liquid with the bottom member a predetermined depth below the member of the body of liquid.

17 Claims, 14 Drawing Sheets

LIQUID COVERING DISKS

BACKGROUND

The present disclosure relates generally to liquid covering disks. In particular, this disclosure describes liquid covering disks that partially float above the surface of a liquid body when deployed.

Ponds and open tanks are often used store and treat liquids. Storing and/or treating liquids is common in the fields of chemical production, anodizing, galvanizing, plating, dying, sewage treatment, oil waste, and other such fields. In many of these fields, the stored liquid may evaporate and emit noxious fumes if exposed to warm and windy conditions.

Additionally, exposed liquid bodies, including both bodies of water and the chemicals used in the fields listed above, may be subject to plant and organism growth on the liquid surface. Unintended plant and organism growth can impair the quality of the stored liquid. The unintended growth can also contribute to noxious fumes and present dangers to surrounding wildlife.

Additionally, exposed liquid bodies may allow wildlife to enter and/or consume the liquid, which poses a threat to both the wildlife in the area surrounding the liquid body and the liquid body itself. It is often desirable to prevent wildlife from entering liquid bodies, as the introduction of wildlife into the liquid bodies may cause degradation in the quality of the stored liquid and create other practical issues with storage and use of the contained liquid. However, preventing wildlife from entering liquid bodies takes on particular importance with respect to liquid bodies containing harmful chemicals, as local wildlife may suffer harm as a result of consuming or entering into the contained liquid.

Some liquid coverings presently understood in the art define a large sheet that covers the entire surface of a liquid body. Such designs are not completely satisfactory, as they require a high cost of deployment. Additionally, sheet liquid coverings, once deployed, are unable to be easily adapted for covering other liquid bodies of differing sizes and shapes.

Thus, there exists a need for a liquid covering that addresses one or more of the shortcomings above. Specifically, a liquid covering that helps protect liquid bodies from heat, sunlight, and wind. Further, a convenient cover to reduce plant and organism growth on the surface of liquid bodies and limit wildlife from entering the liquid is needed.

In addition to solving the problems listed in the preceding paragraphs, there exists a need for a device that is easily adaptable to liquid bodies of different shapes and/or sizes while substantially limiting the price of fabrication. Some in the art have approached this problem by creating a plurality of similar polygonal coverings designed to be placed on the surface in concert, substantially nested, packed arrangement, and covering substantially all of the liquid body. However, the lightweight design of these liquid coverings leave them susceptible to being blown away from the liquid body in windy conditions. Heavier designs that are less affected by the wind suffer from high shipping costs.

As a result, known liquid covering devices are not entirely satisfactory for the range of applications in which they are employed. Specifically, there exists a need for liquid coverings that protect against the harms listed above, while being wind resistant, easily adaptable to various liquid bodies, and of limited cost to manufacture. Additionally, a liquid cover with a light shipping weight and a heavier deployed weight to limit shipping costs is desired. Examples of new and useful liquid covering disks relevant to the needs existing in the field are discussed below.

SUMMARY

Disks configured to float on the surface of a body of liquid, including a top member configured to float substantially above the surface of the body of liquid, a bottom member spaced from the top member and configured to float substantially below the surface of the body of liquid, a sidewall extending between the top member and the bottom member along the periphery of the top member and along the periphery of the bottom member, wherein the top member, the bottom member, and the sidewall collectively define a cavity, a chamber mounted within the cavity, the chamber enclosing a predetermined volume of a gas, and a port defined in the sidewall to allow liquid from the body of liquid to enter the cavity, wherein the predetermined volume of gas enclosed in the chamber is selected to impart a buoyancy force sufficient to maintain the disk afloat on the body of liquid with the bottom member a predetermined depth below the member of the body of liquid.

DETAILED DESCRIPTION

Figure 1:
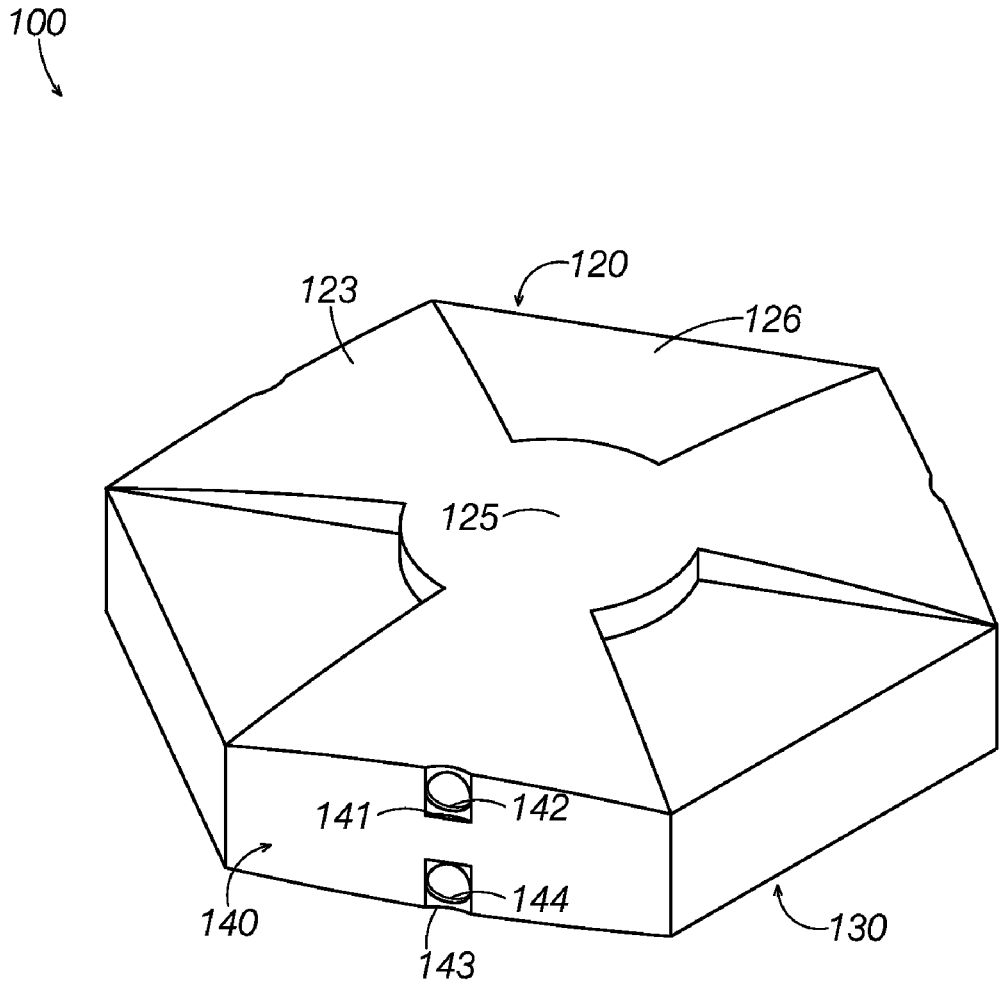
FIG. 1: A perspective view of a liquid covering disk.

The disclosed Error! Reference source not found. will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various Error! Reference source not found. are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-7, a liquid covering disk 100 includes a top member 120, a bottom member 130, and a sidewall 140, which includes a sidewall exterior surface and a sidewall interior surface 164. Liquid covering disk additionally includes a collection of internal components, including a cavity 160 and a chamber 170. In operation, liquid covering disk 100 floats with top member 120 substantially above the surface of the liquid body and bottom member 130 substantially below the surface of the liquid body. Liquid covering disk 100 may additionally be used in concert with a collection of similar liquid covering disks to cover large liquid body surfaces.

Top member 120 includes an exterior surface and an interior surface 162, which may be referred to as a top member exterior surface and a top member interior surface. Additionally, bottom member 130 includes an exterior surface and an interior surface 166, which may be referred to as a bottom member exterior surface and a bottom member interior surface.

Liquid covering disk 100, or a collection thereof, function to reduce heat loss and evaporation, suppress waves, reduce foam formation, and prevent the emission of noxious or toxic fumes from a body of liquid on which liquid covering disk 100 is deployed. More specifically, liquid covering disk 100 performs this task while implementing a wind-resistant design by allowing a quantity of liquid to enter into cavity 160. Indeed, the weight of liquid in the cavity increases the apparent weight of liquid covering disk 100 when deployed, which makes disk 100 less affected by the wind.

Figure 2:
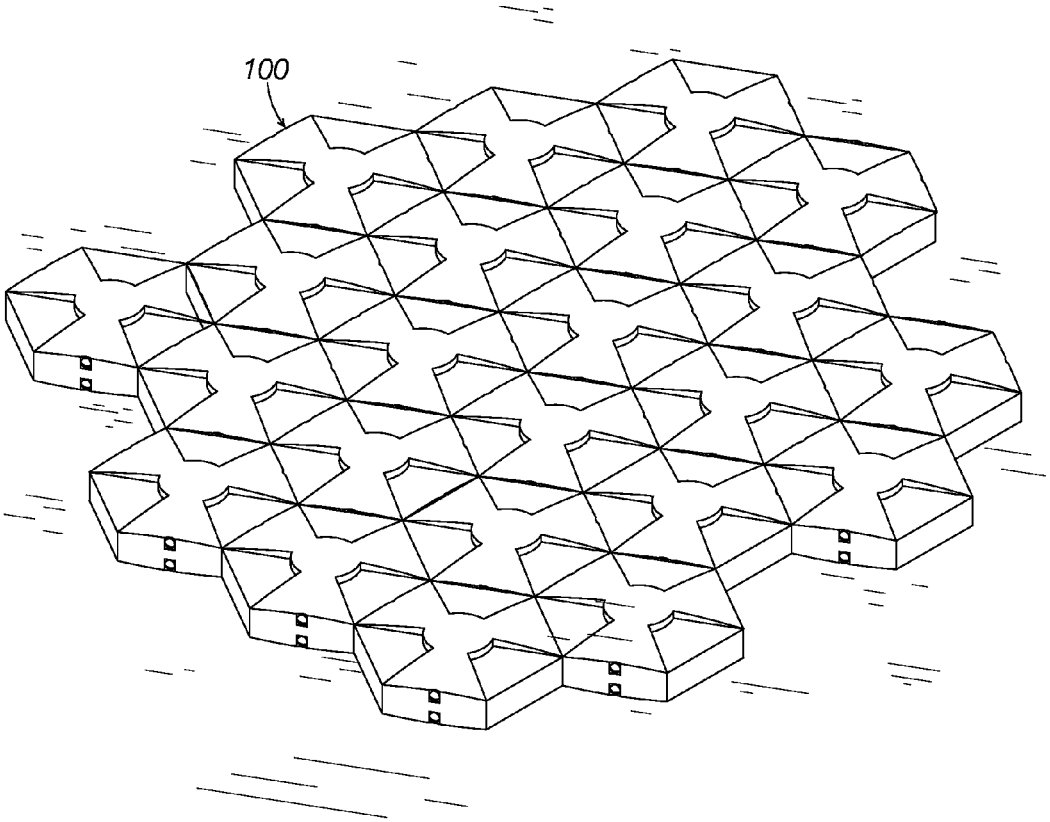
FIG. 2: A perspective view of an array of liquid covering disks floating on a liquid to define a liquid cover.
Figure 3:
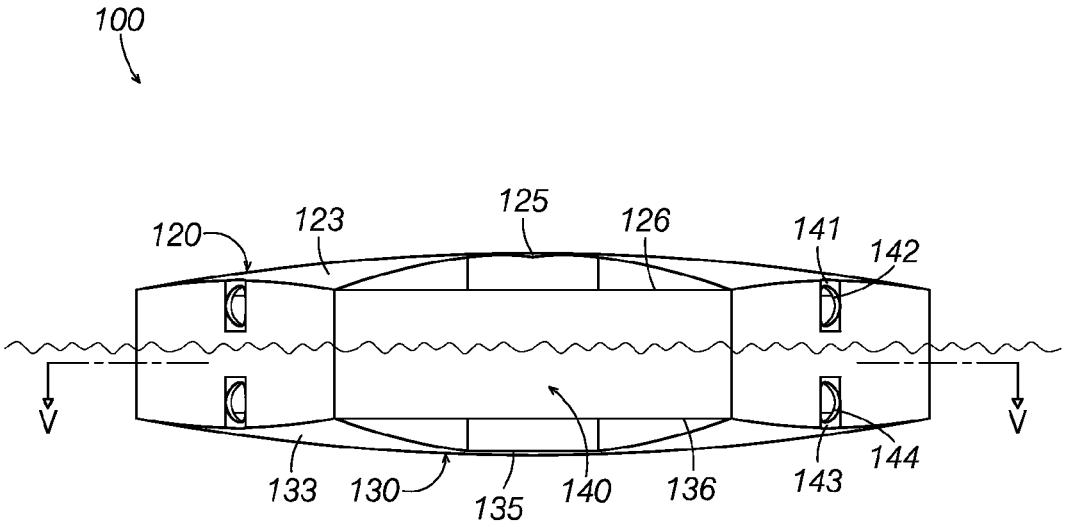
FIG. 3: A side elevation view of the liquid covering disk shown in FIG. 1 floating in and partially filled with liquid.
Figure 4:
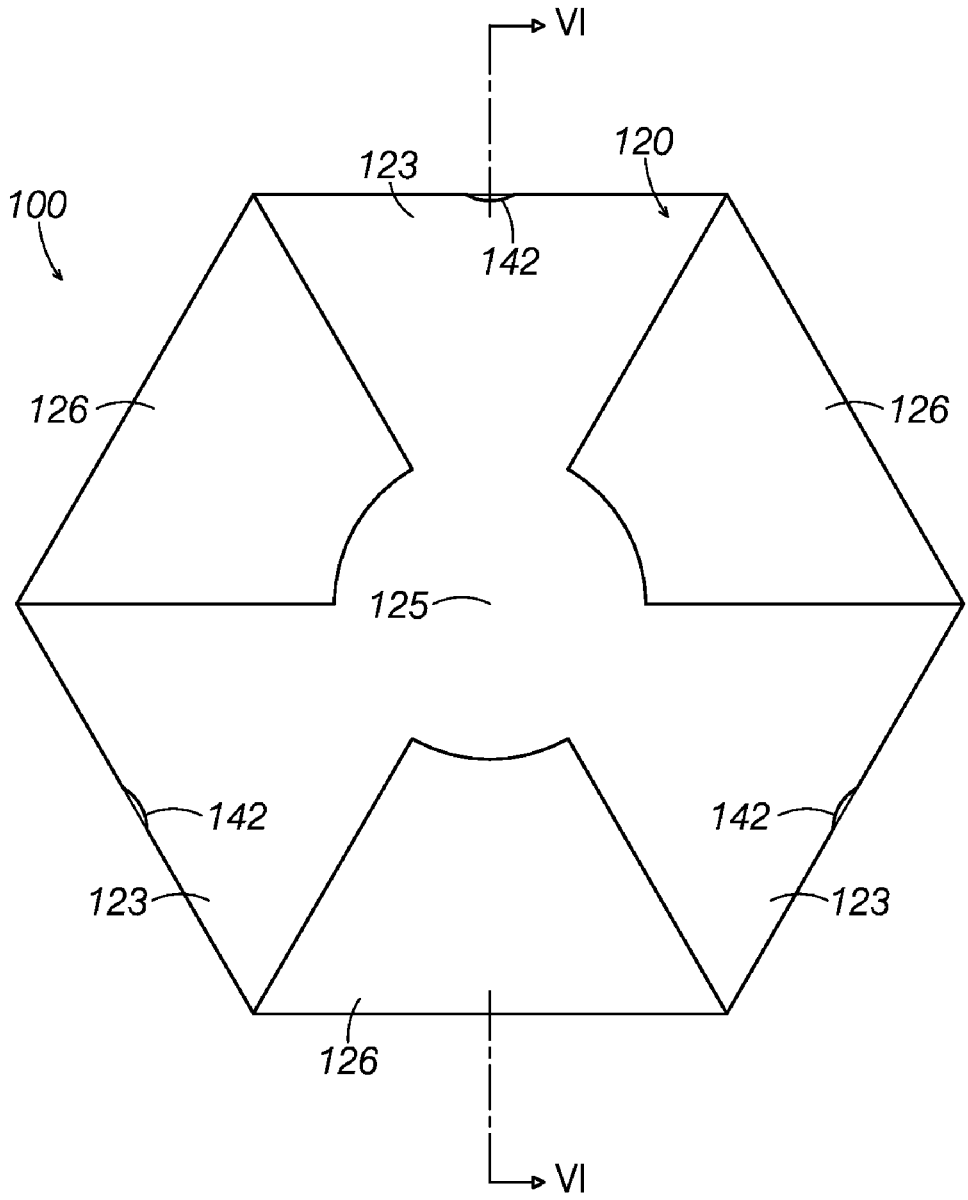
FIG. 4: A top elevation view of the liquid covering disk shown in FIG. 1.
Figure 5:
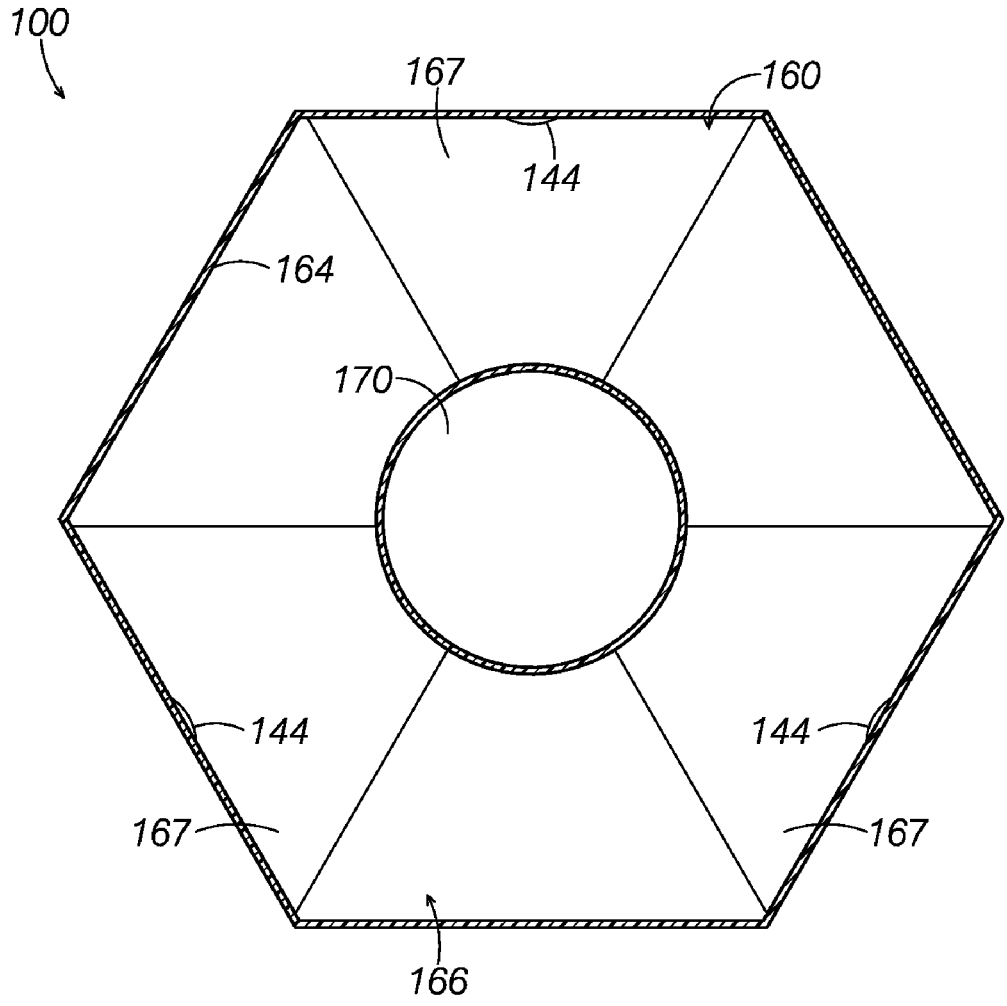
FIG. 5: A top plan view of the liquid covering disk shown in FIG. 1, with a portion of the top surface removed to show internal components

As can be seen in FIGS. 1-3, top member 120 has a substantially hexagonal lateral periphery and defines a protuberance 125, and a collection of spokes 123. Top member 120 functions primarily to reduce exposure of the liquid body to sunlight and other external heat and light sources.

The top member exterior surface includes a substantially cylindrical protuberance 125 that projects from the center of the top member 120. Additionally, three substantially trapezoidal spokes 123 radiate out from protuberance 125 towards sidewall 140, each spoke covering approximately one sixth of the top member exterior surface. As one can see in FIG. 1, spokes 123 gradually ascend as they approach protuberance 125.

Spokes 123 and protuberance 125 additionally define recesses or notches 126. Notches 126 gradually descend as they approach protuberance 125, eventually descending to a vertical point lower than the top of sidewall 140. Each spoke 123 defines two surfaces which define faces of notches 126. Protuberance 125 defines three vertical surfaces defining an inner, annular face of notches 126. When a collection of liquid covering disks are used in concert and wind is present, the wind may push upon these notch faces and push the liquid covering disks more closely together and reduce gaps in the coverage between them.

Although protuberance 125 is substantially cylindrical in shape with a substantially flat top, this disclosure specifically contemplates protuberances that implement concave designs in the top as well.

As FIGS. 1-7 show, liquid disk covering 100 additionally includes a sidewall 140 that substantially defines a projection of the hexagonal periphery defined by top member 120. Sidewall 140 extends between the bottom member 130 and top member 120. Sidewall 140 and top member 120 are connected such that they form a unified body, and their connection spans the entire perimeter of both sidewall 140 and top member 120. Sidewall 140 is similarly connected to bottom member 130.

Sidewall 140 includes complimentary pairs of upper port notches 141 and upper ports 142 on three of its alternating sides. Sidewall 140 additionally includes complimentarily pairs of lower port notches 143 and lower ports 144 on the same sides. The port notches define small indentations in sidewall 140, each indentation slightly larger than the corresponding port.

Upper ports 142 define small circular holes in sidewall 140 that open into cavity 160. Upper ports 142 function primarily to allow air and any other gas to pass in and out of liquid covering disk 100 as liquid enters or exits cavity 160, substantially regulating atmospheric pressure therein.

Upper port notches 141 substantially define slight square notches in sidewall 140 that surround upper ports 142. The recession of upper port notches 141 allow for a gap between upper ports 142 when a collection of liquid covering disks are used in concert and are nested in a closed, packed pattern. This gap allows air and other gasses to more easily pass through upper ports 142 when in such a nested pattern, whereas other liquid covering disks in the tightly packed pattern may otherwise substantially restrict such flow.

Lower ports 144 define small circular holes in sidewall 140 that open into cavity 160. In normal operation, lower ports 144 function primarily to allow liquid from the liquid body to pass in and out of cavity 160 defined in liquid covering disk 100. Liquid covering disk 100 is designed to allow a predetermined volume of liquid to maintain the disk afloat on the body of liquid with bottom member 130 a predetermined depth below the surface of the body of liquid in view of cavity 170 and any gas contained therein.

Lower port notches 143 substantially define slight square notches in sidewall 140 that surround lower ports 144. The recession of lower port notches 143 allow for a gap between lower ports 144 when a collection of liquid covering disks are used in concert and are nested in a closed, packed pattern. This gap allows liquid to more easily pass through lower ports 144 when in such a nested pattern, whereas other liquid covering disks in the tightly packed pattern could otherwise potentially restrict such liquid flow.

Liquid covering disk additionally includes a bottom member 130 that mirrors top member 120. For the sake of brevity, the elements of bottom member 130 will not be described in detail. However, bottom member 130, like top member 120, includes a protuberance 135, spokes 133, and notches 136 that are substantially the same shape and size as the corresponding parts on top member 120. Although top member 120 and bottom member 130 are substantially similar, this is not specifically required, and liquid covering disks with different top members and bottom members are equally within this disclosure.

Bottom member 130, sidewall 140, and top member 120 collectively define cavity 160, which functions to contain liquid introduced from the liquid body through the liquid disk covering's ports.

Figure 6:
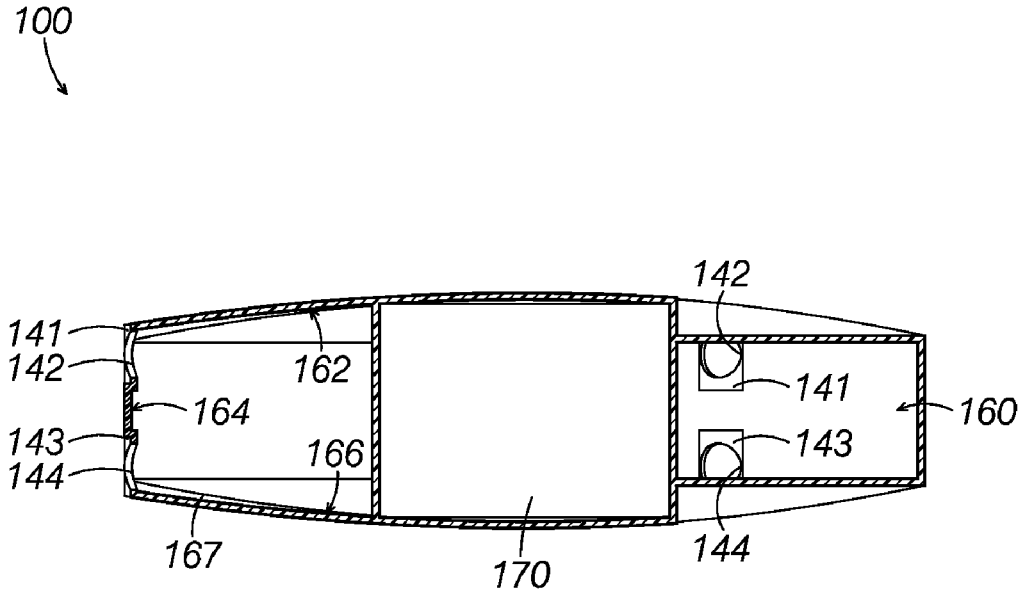
FIG. 6: A side elevation view of a cross section of the liquid covering disk shown in FIG. 1 about line VI-VI shown in FIG. 4.
Figure 7:
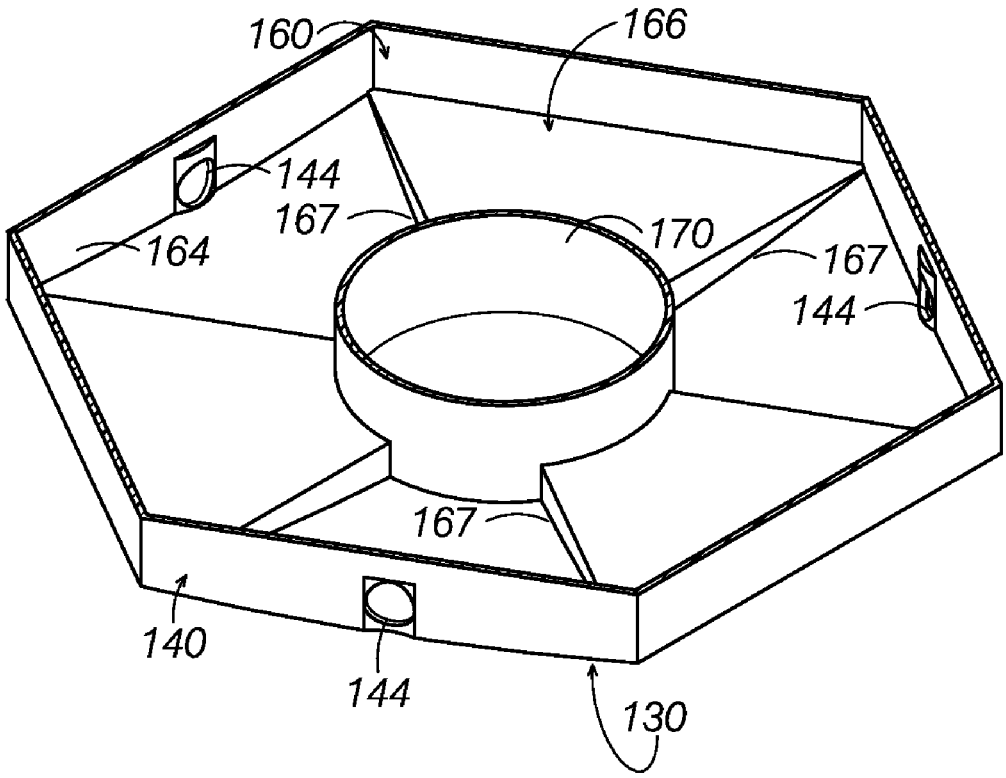
FIG. 7: A perspective view of a bottom half of the liquid covering disk shown in FIG. 1, with the top half removed to show internal components.

As illustrated in FIG. 7, liquid disk covering 100 includes a collection of interior components, including cavity 160 and chamber 170. Cavity 160 extends between top member interior surface 162, side wall interior surface 164, bottom member interior surface 166, and chamber 170. As illustrated in FIG. 6, cavity 160 defines an open area on the interior of liquid disk covering 100 that functions to contain a predetermined amount of liquid from a liquid body when liquid disk covering 100 is deployed.

As previously stated, upper ports 142 and lower ports 144 open from cavity 160 to the exterior of liquid covering disk 100, and allow liquid and gasses to pass in and out of cavity 160.

Top member interior surface 162 and bottom member interior surface 166 are the opposing sides of the top member exterior surface and the bottom member exterior surface, respectively. As a result, top member interior surface 162 and bottom member interior surface 166 share a similar, but reflected, shape as the top member exterior surface and the bottom member exterior surface, respectively. For the sake of brevity, all of the details of these designs specific designs in liquid covering disk 100 will not be reiterated. However, it is noted that the shape of bottom member 130's spokes 133 create a plurality of cavity recesses 167, which are recessed from the rest of bottom member interior surface 166.

Cavity recesses 167 are spaced inside cavity 160 to help distribute the apparent weight of disk 100 when filled with liquid. Liquid entering cavity 160 through lower ports 144 naturally flows into recessed areas 167. Spaced apart cavity recesses 167 initially filling with liquid helps inhibit disk 100 from tipping as cavity 100 fills with liquid.

Expressed another way, cavity recesses 167 assist liquid in settling into a position within cavity 160 with even weight distribution of the liquid, keeping liquid covering disk 100 in a substantially flat position covering the liquid body.

As FIG. 6 illustrates, the interior of liquid covering disk 100 additionally includes chamber 170 positioned substantially at the center of cavity 160. Chamber 170 defines a hollow cylinder made of an air and water tight material. Chamber 170 extends from bottom member interior surface 166 to top member interior surface 162. In liquid covering disk 100, chamber 170's radius is substantially the same as protuberance 125.

Although chamber 170 vertically spans the entire height of liquid covering disk 100, this is not specifically required, and chambers that span only a portion of the height of a liquid covering disk, whether attached at the top or bottom of the liquid covering disk's cavity, are equally within this disclosure.

Chamber 170 encloses a predetermined amount of a gas, such that when a liquid covering disk is placed in water, the buoyant force of the substance enclosed in chamber 170 combined with any buoyant force created by the density of the disk's construction material is sufficient to maintain the disk afloat on the body of liquid with its bottom member exterior surface a predetermined depth below the surface of the body of liquid. A quantity of liquid from the body of liquid may additionally be introduced into the disk's cavity and be used to apply an additional downward force to the liquid covering disk. To increase the buoyancy, a greater volume of gas may be enclosed in chamber 170. To decrease the buoyancy, the volume of gas enclosed in chamber 170 may be decreased.

Adjusting a liquid covering disk's buoyancy may be additionally or alternatively achieved by adjusting the substance contained within the chamber. In liquid covering disk 100, air is the substance contained within chamber 170. However, this disclosure is not specifically limited to the use of air, and this disclosure specifically contemplates the use of any gas within the chamber.

Non-gas substances, including, but not limited to, foams and other solids that are generally understood to define packets of trapped gas and be buoyant when placed within a liquid may also be placed inside the chamber. In some examples, the buoyant solid material is impermeable to liquid such that it can be used to add buoyancy to the disk in examples where the chamber is not sealed and liquid enters the chamber. This disclosure is additionally not limited to substances generally understood to be buoyant; in some instances, it may be beneficial to use dense substances in order to add more stability to the liquid covering disk while positioned in a liquid body.

Liquid covering disks may additionally be designed to receive differing quantities of liquid into its cavity. This may be achieved by modifying the size of the recessed areas of the bottom member interior surface. This disclosure specifically considers cavity recesses of any size, including cavities that are completely open on the lower half. For instance, if the recessed areas are reduced in size, the liquid contained within the cavity below the ports will reduce, potentially causing a lesser amount of liquid to be included in the cavity of the liquid covering disk.

By adjusting both the buoyant force created by the substance in the chamber and the quantity of liquid that is introduced into the cavity, liquid covering disks may be designed to float at different depths. Adjusting the chamber buoyancy and the amount of liquid within the cavity to introduce a greater amount of water weight in the interior of liquid covering disk, may be desirable for adjusting the disk's wind resistance. These modifications may also be useful in adapting liquid covering disks for use in liquids of varying densities. Liquid covering disks for the purposes of this disclosure may be anywhere from 10% to 60% submerged when deployed on a liquid body, depending on the various design options disclosed.

Liquid covering disk 100 and all of its components are composed entirely out of an ultraviolet stabilized high density polyethylene. The use of ultraviolet stabilized high density polyethylene helps ensure the disk maintains its integrity during outdoor use over an extended period of time. In liquid covering disk 100, adding carbon black to the polyethylene, at a ratio of 2%, provides ultraviolet light protection and stabilization. However, liquid covering disks are not constrained to this specific ratio of ratio of carbon black, nor by the use of high density polyethylene as the main constituent of the liquid covering disk. For example, ultraviolet light protection or stabilization may be achieved by adding carbon black to the main constituent of the disk, such as the aforementioned high density polyethylene or polypropylene, in a ratio of approximately 2 to 10%.

Additionally or alternatively, this disclosure specifically contemplates both liquid covering disks that include an ultraviolet stabilizer and those that do not.

The high density polyethylene used in liquid covering disk 100 is buoyant in water, but this property of liquid covering disks' construction material is not necessary. For instance, a liquid covering disk may implement construction materials of varying densities and buoyancies.

Liquid disk covering 100 is shown in the figures with a specific hexagonal shape when viewed vertically, but this shape is not explicitly required in every embodiment of liquid disk coverings. For example, the disk may take a wide variety of shapes, including, but not limited to, polygonal, elliptical, or non-polygonal shapes. Certain shape examples include attachment members, such as complimentarily configured projections and recesses positioned around the liquid covering disk's perimeter when viewed from above.

Additionally, liquid covering disk 100 includes several topographic features on its top member exterior surface and bottom member exterior surface; however, these features are not required. Top member exterior surfaces and bottom member exterior surfaces that contain no such features are equally within this disclosure.

Additionally or alternatively, this disclosure contemplates a disk including a bottom member interior surface that defines a depression without the topographic features inside the cavity of disk 100. The depression may allow contained fluid to collect evenly inside the cavity. The depression may facilitate maintaining the disk substantially level relative to the surface of the liquid as the cavity fills with liquid.

Figure 13:
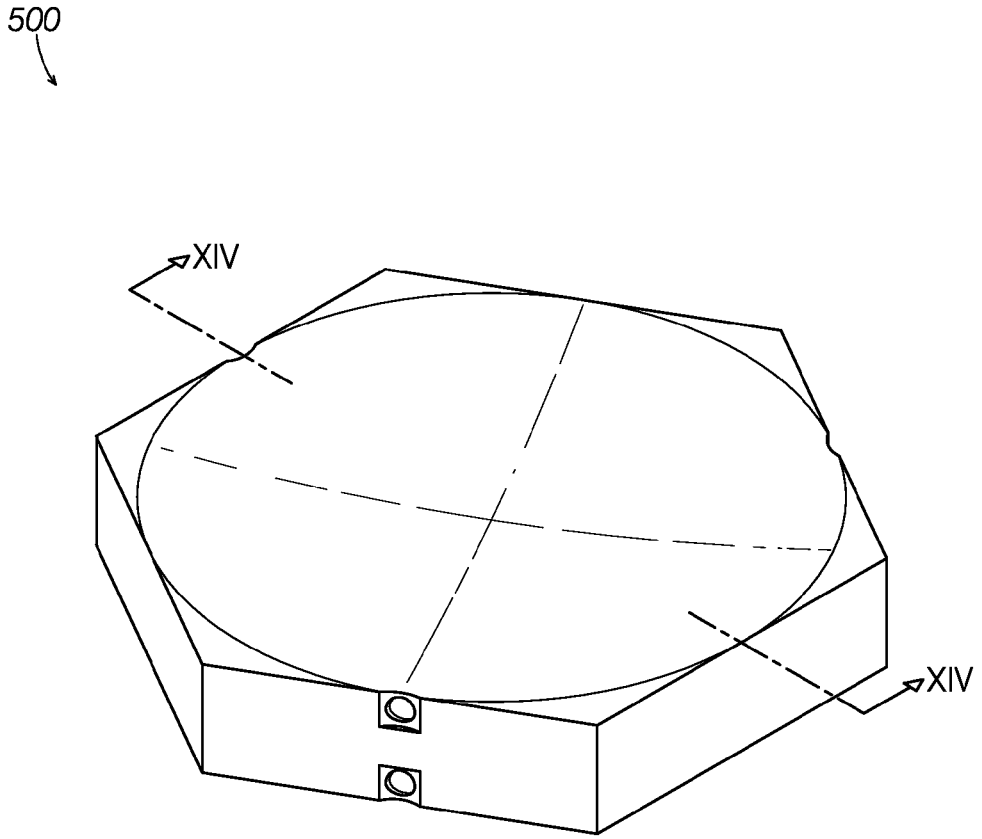
FIG. 13: A perspective view of a fifth example of a liquid covering disk that includes a depression on its top and bottom surfaces.
Figure 14:
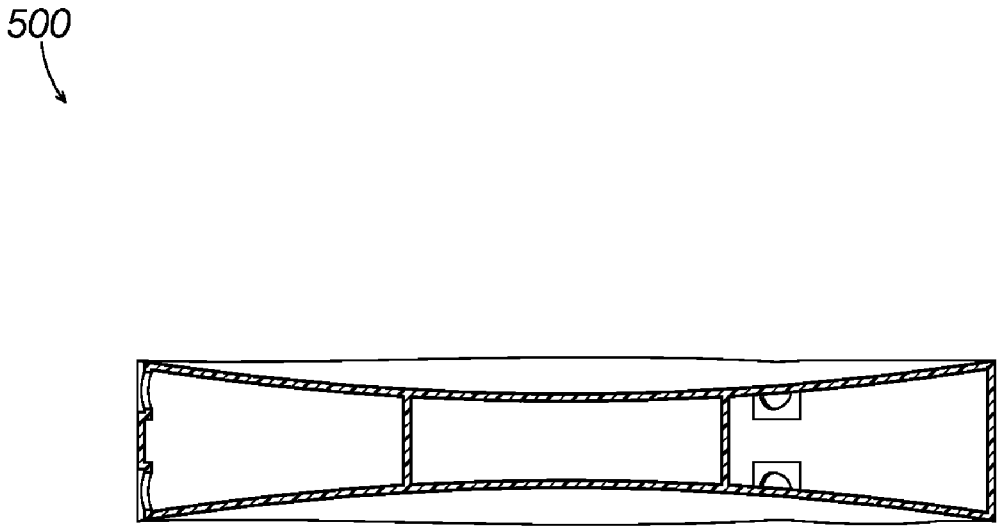
FIG. 14: An elevation view of a cross section of a liquid covering disk illustrated in FIG. 13 about line XIV-XIV in FIG. 13.

As stated before, the center of top member exterior surface is at a higher elevation relative to its lateral periphery. However, this disclosure specifically contemplates liquid covering disks with substantially flat exterior top and bottom surfaces. This disclosure additionally specifically contemplates liquid covering disks in which the either the top member, bottom member, or both, define a depression, or lowers in elevation as one approaches the center. FIGS. 13 and 14 illustrate an example of a liquid covering disk 500 including top member exterior surface and bottom member exterior surface defining depressions.

Figure 8:
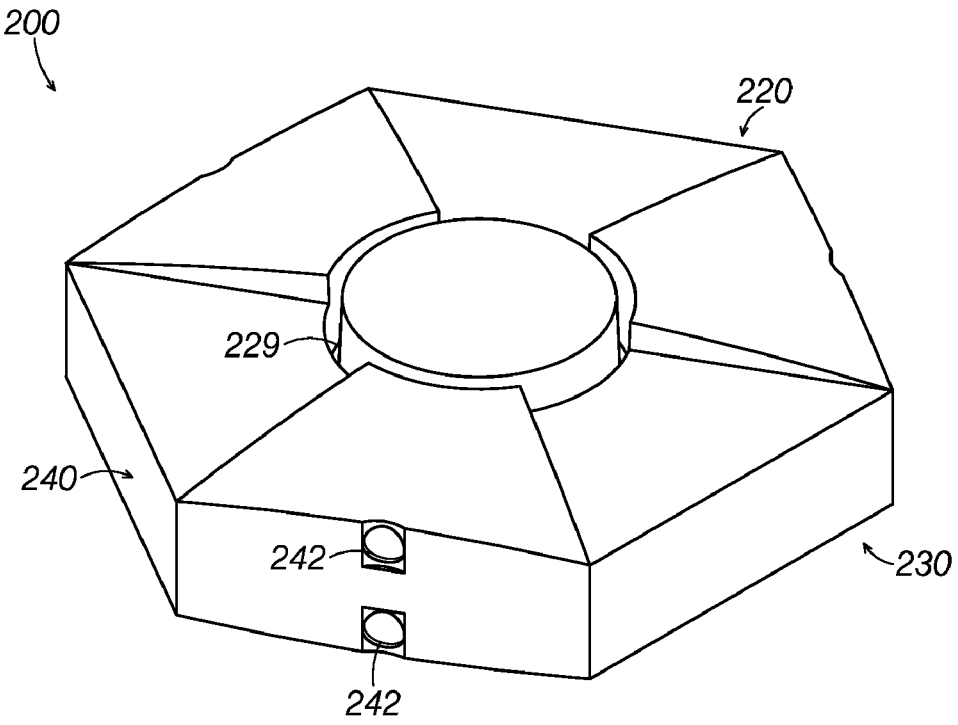
FIG. 8: A perspective view of a second example of a liquid covering disk including a groove on the top and bottom surfaces.

Turning attention to FIG. 8, a second example of a liquid covering disk 200 will now be described. Liquid covering disk 200 includes many similar or identical features to liquid covering disk 200. Thus, for the sake of brevity, each feature of liquid covering disk 200 will not be redundantly explained. Rather, key distinctions between liquid covering disk 200 and liquid covering disk 100 will be described in detail and the reader should reference the discussion above for features substantially similar between the two liquid covering disks.

Figure 9:
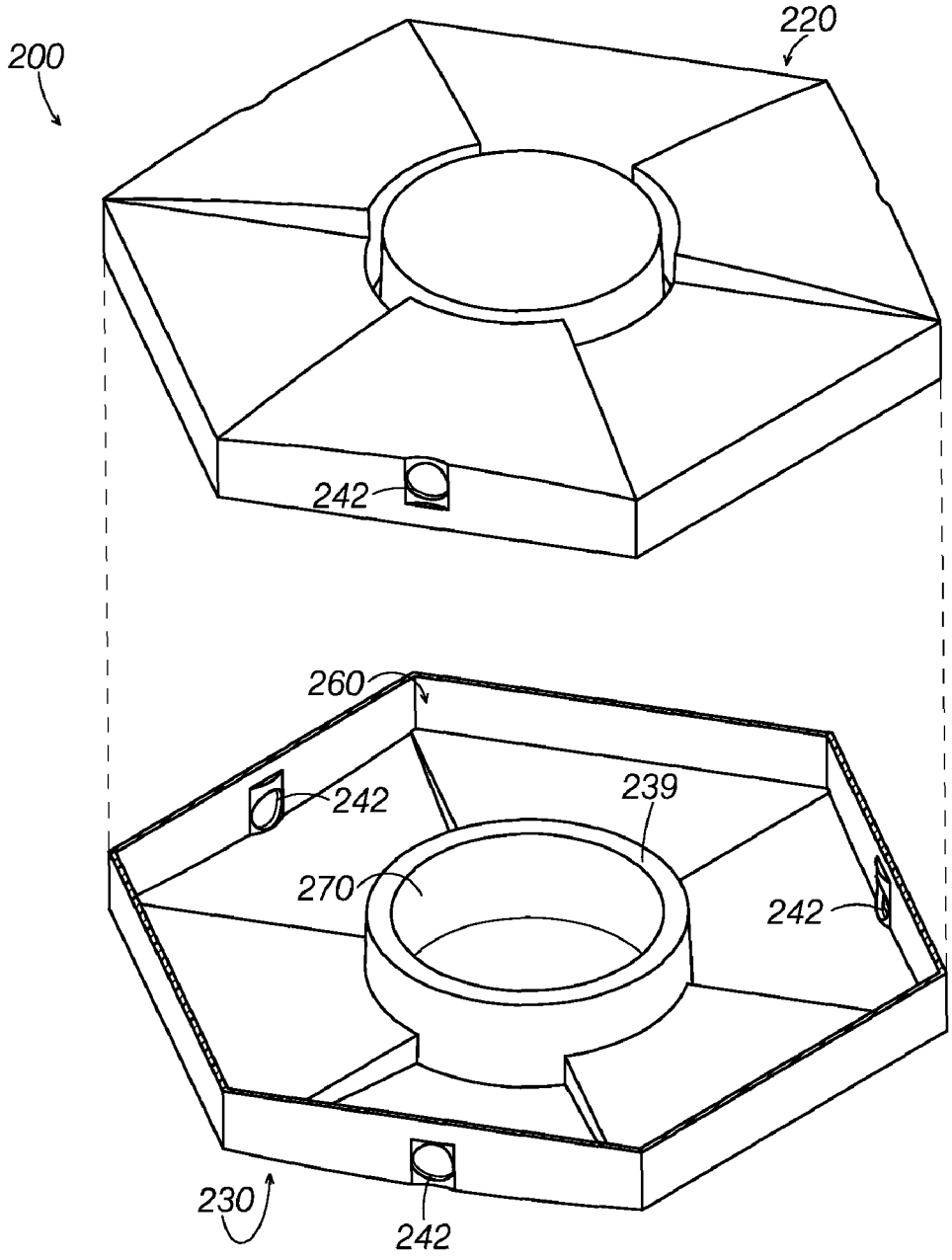
FIG. 9: An exploded perspective view of the example of a liquid covering disk illustrated in FIG. 8.

As can be seen in FIGS. 8 and 9, liquid covering disk 200 includes a top member 220, which includes a top member exterior surface and a top member interior surface, a bottom member 230, which includes a bottom member exterior surface and a bottom member interior surface, a sidewall 240, including ports 242, a cavity 260, and a chamber 270. The primary difference between liquid covering disk 200 and liquid covering disk 100 is the existence of a top groove 229 on top member 220 surrounding cavity 260 and a similar bottom groove 239 on bottom member 230.

Top member 220 includes an exterior surface and an interior surface, which may be referred to as a top member exterior surface and a top member interior surface. Additionally, bottom member 230 includes an exterior surface and an interior surface, which may be referred to as a bottom member exterior surface and a bottom member interior surface.

As FIG. 8 shows, top member 220 of disk 200 includes top groove 229 positioned on its perimeter. Groove 229 defines a recess in the top member exterior surface that substantially surrounds the perimeter of chamber 270. Groove 229 provides an additional surface on top member 220's top member exterior surface to catch wind when used in windy conditions, which may, in turn, help push liquid covering disks closer together when used in concert.

Additionally, as seen in FIG. 9, bottom member 230 includes a bottom lip 239 inside cavity 260. Lip 239 defines a portion of chamber 270. When an identical lip defined by top member 220 is aligned with lip 239, chamber 270 is fully formed.

Although upper and lower ports are not explicitly differentiated in liquid covering disk 200 illustrated in FIGS. 8 and 9, ports 242 are designed to accommodate both the flow of liquid and/or air as achieved by upper ports 142 and lower ports 144 while in operation.

Figure 10:
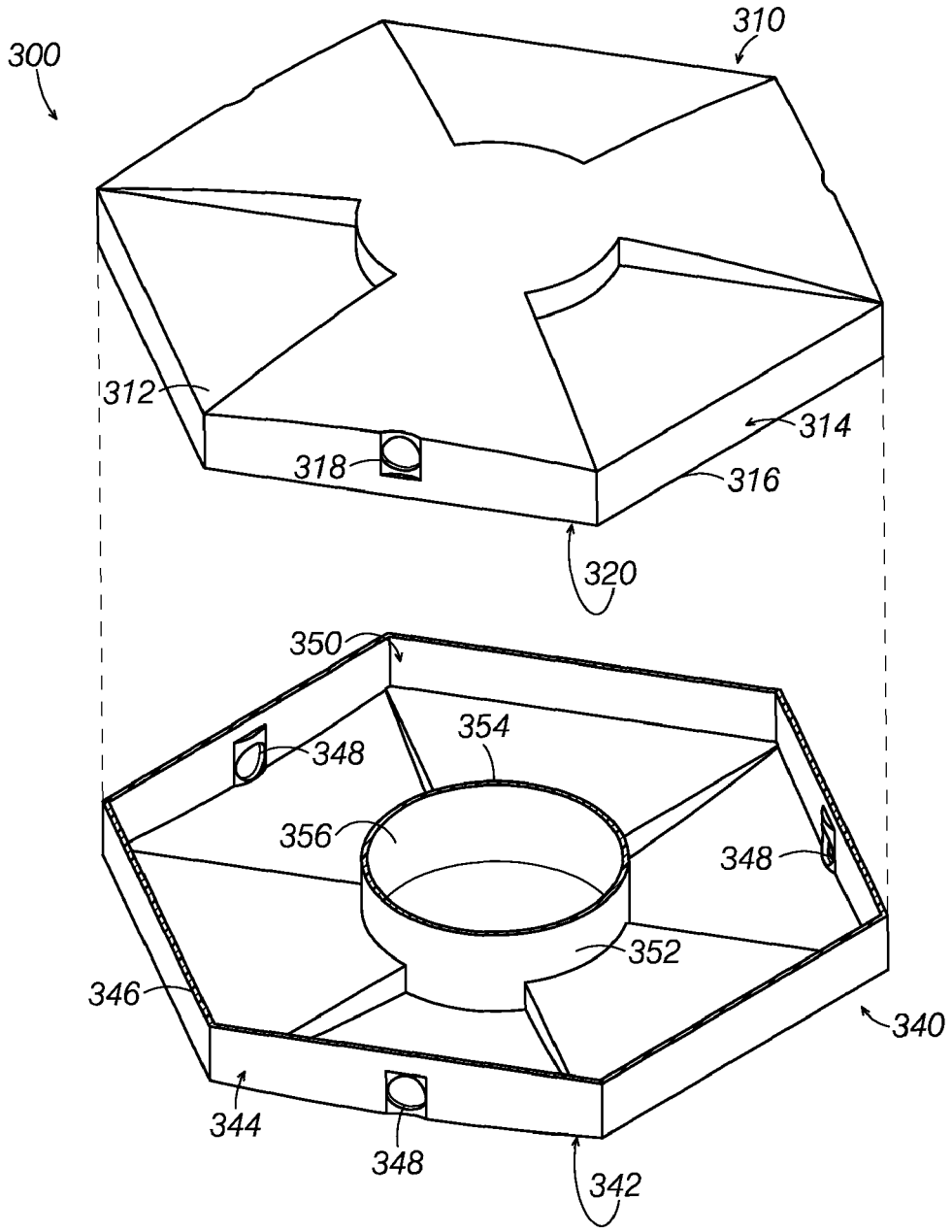
FIG. 10: An exploded perspective view of a third example of a liquid covering disk.

Turning attention to FIG. 10, a third example of a liquid covering disk 300 will now be described. Liquid covering disk 300 includes a top portion 310, including a top member 312, a top periphery wall 314, a top periphery wall terminal end 316, top ports 318, a top cavity 320, a top chamber wall, a top chamber wall terminal end, and a top chamber. Liquid covering disk 300 additionally includes a bottom portion 340, which includes a bottom member 342, a bottom periphery wall 344, a bottom periphery wall terminal end 346, bottom ports 348, a bottom cavity 350, a bottom chamber wall 352, a bottom chamber terminal end 354, and a bottom chamber 356.

Top member 312 includes an exterior surface and an interior surface, which may be referred to as a top member exterior surface and a top member interior surface. Additionally, bottom member 342 includes an exterior surface and an interior surface, which may be referred to as a bottom member exterior surface and a bottom member interior surface.

As illustrated, the lateral periphery of top portion 310 substantially defines a hexagon. Top member 312 is substantially similar to top member 120, including a similar shape, size, and topography.

Top periphery wall 314 defines a surface extending around the entire perimeter of top portion 310. Top periphery wall 314 is connected on its top to the bottom of top member 312's perimeter and extends to a top periphery wall terminal end 316, which is a selected point below top member 312. Top periphery wall 314 and top member 312 define top cavity 320, which includes the interior of their combined convex shape.

Top periphery wall 314 additionally includes top ports 318 around its perimeter. Top ports 318 define openings between the exterior of top portion 310 and top cavity 320. Top ports 318 are designed to allow air to pass in and out while liquid covering disk 300 is partially submerged in a liquid body.

Top portion 310 additionally includes a top chamber wall (not shown) extending transversely from the top member 312's interior surface to a top chamber wall terminal end, which is a selected point below top member 312. Top chamber wall terminal end and top periphery wall terminal end 316 terminate a common horizontal plane. Top chamber wall extends in a continuous circular path and defines a top chamber.

As seen in FIG. 10, the lateral periphery of bottom portion 340 substantially defines a hexagon. Bottom member 342 is substantially similar to bottom member 130, including a similar shape, size, and topography.

Bottom periphery wall 344 defines a surface extending across the entire perimeter of bottom portion 340. Bottom periphery wall 344 is connected on its bottom to the bottom of bottom member 342's perimeter, and extends to a bottom periphery wall terminal end 346 which is a selected point above bottom member 342. Bottom periphery wall 344 and bottom member 342 define bottom cavity 350, which includes the enclosed area of their combined convex shape.

Bottom periphery wall 344 additionally includes bottom ports 348 around its perimeter. Bottom ports 348 define openings between the exterior of bottom portion 340 and bottom cavity 350. Bottom ports 348 are designed to allow a quantity of liquid to be introduced in to bottom cavity 350 when liquid covering disk 300 is partially submerged in a liquid body. Bottom cavity 350 is additionally designed to evenly collect water from bottom ports 348, specifically in the recessed areas of bottom member interior surface.

Bottom portion 340 additionally includes a bottom chamber wall 352 extending transversely from the bottom member 342's interior surface to a bottom chamber wall terminal end, which is a selected point below bottom member 342. Bottom chamber wall terminal end 354 and bottom periphery wall terminal end 346 terminate at a common horizontal plane. Bottom chamber wall 352 extends in a continuous circular path and defines a bottom chamber 356 in its enclosed space.

Liquid covering disk 300 defines a combination of top portion 310 and 340. The two elements are combined at two points. First, top periphery wall terminal end 316 is attached to bottom periphery wall terminal end 346 via a welded union of these two points. Second, top chamber wall terminal end 324 is attached to bottom periphery wall terminal end 354 via a welded union of these two points.

The connections at both of these welded unions are water and air tight, allowing liquid and air to enter the combined cavity only through top port 318 and bottom port 348. Additionally, the air and water tight union between the top chamber wall terminal end 324 and bottom chamber wall terminal end 354 substantially ensures that nothing may enter or exit the combined chamber after the welds have been made.

Figure 11:
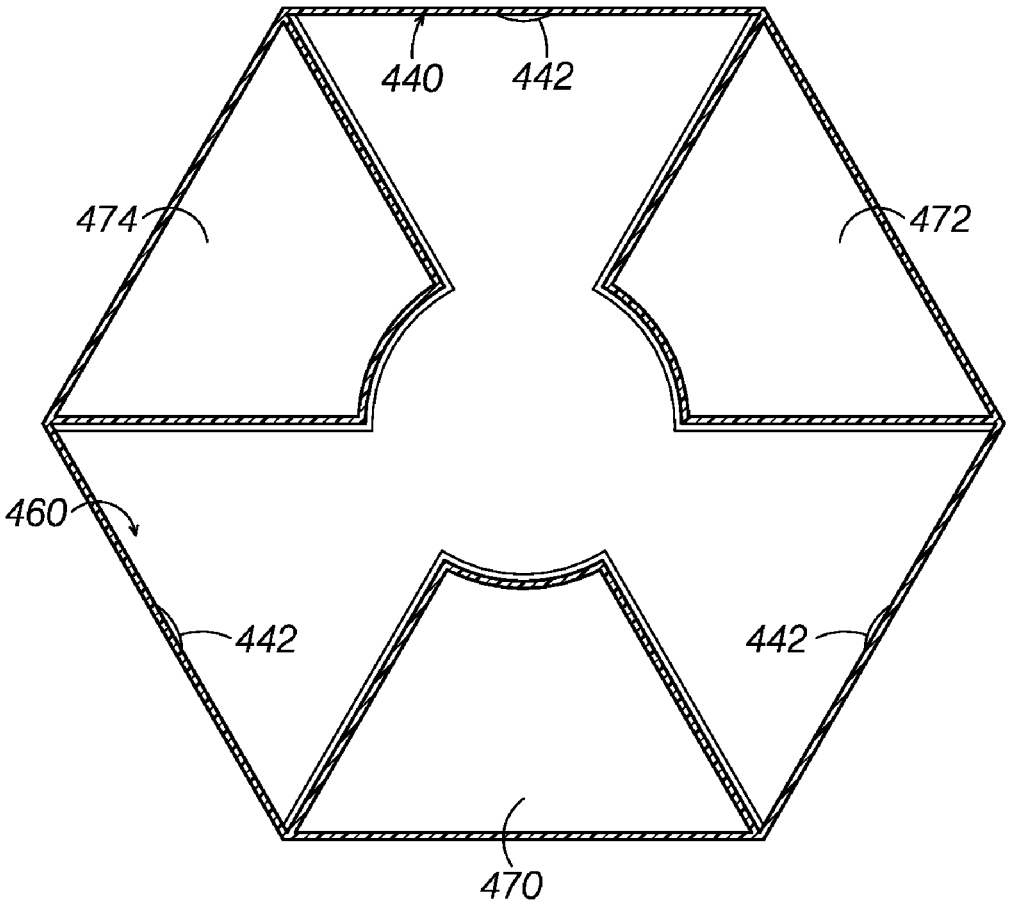
FIG. 11: A top view of a fourth example of a liquid covering disk that includes three chambers with the top half removed to show internal components.
Figure 12:
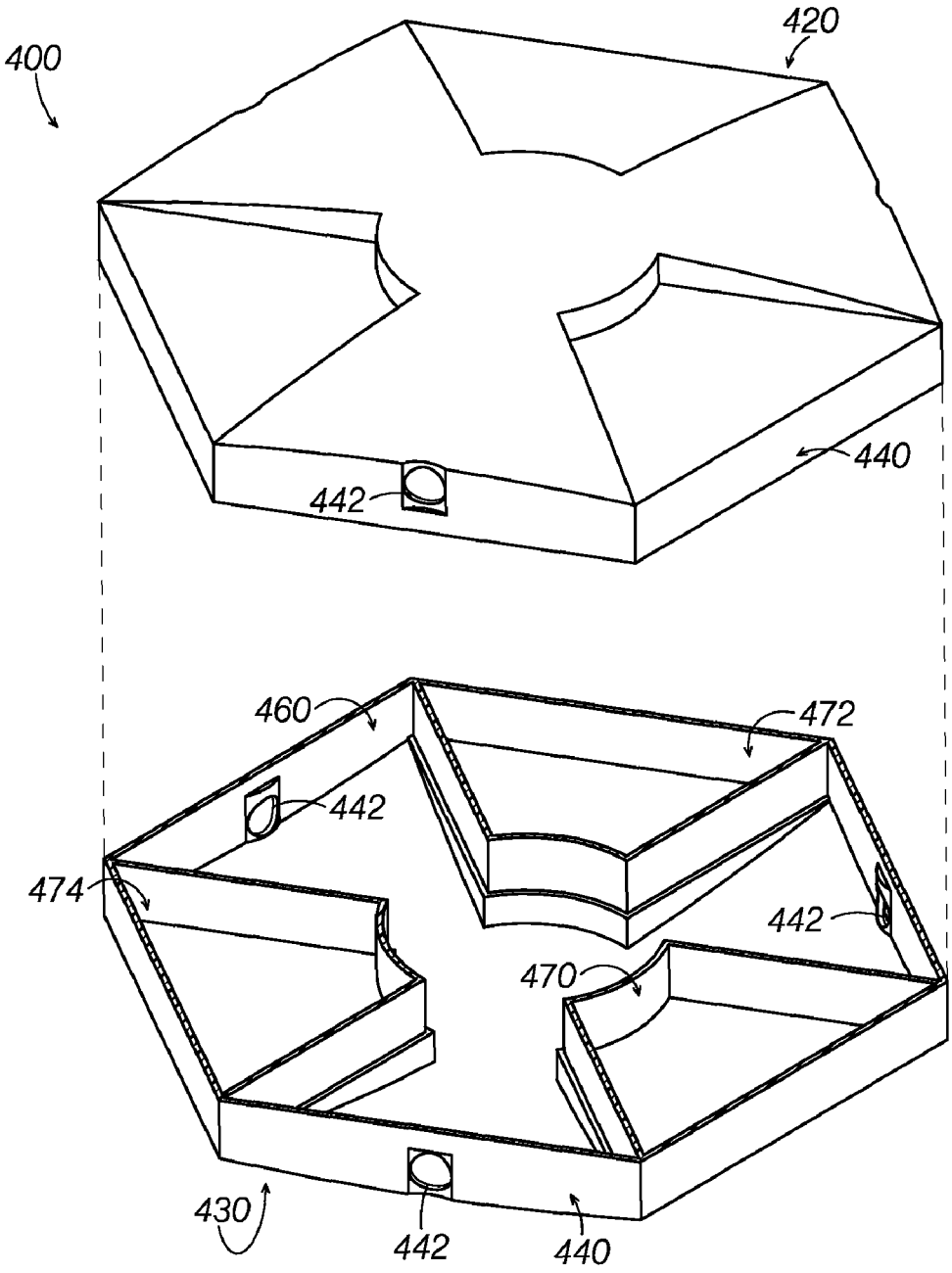
FIG. 12: An exploded perspective view the liquid covering disk illustrated in FIG. 11.

Turning attention to FIGS. 11 and 12, a fourth example of a liquid covering disk 400 will now be described. Liquid covering disk 400 includes many similar or identical features to liquid covering disks 100, 200, and 300. Thus, for the sake of brevity, each feature of liquid covering disk 400 will not be redundantly explained. Rather, key distinctions between liquid covering disk 400 and liquid covering disks 100, 200, and 300 will be described in detail and the reader should reference the discussion above for features substantially similar between the different liquid covering disks.

As seen in FIGS. 11 and 12, liquid covering disk 400 includes a top member 420, a bottom member 430, a sidewall 440, defining ports 442, a cavity 460, a first chamber 470, a second chamber 472, and a third chamber 474. The design of liquid covering disk is substantially open between ports 442 and the center of cavity 460, allowing any liquid entering through ports 442 to collect substantially at the center of cavity 460.

The elements of liquid covering disk 400 substantially share the same design as the corresponding elements in liquid covering disk 100. Although different in shape and position, chamber 470, chamber 472, and chamber 474 are all water tight similar to chamber 170. Additionally, chamber 470, chamber 472, and chamber 474 may be filled in the same ways discussed in relation to chamber 170.

A key difference between liquid covering disk 400 and liquid covering disk 100 lies in the placement of the chambers away from the center of the cavity. Locating chamber 470, chamber 472, and chamber 474 away from the center allows water to collect in the center of liquid covering disk 400. Water collecting at the center may allow liquid covering disk 400 to maintain a more stable position while partially submerged in a liquid body.

Although upper and lower ports are not explicitly differentiated in liquid covering disk 400 illustrated in FIGS. 11 and 12, ports 442 are designed to accommodate both the flow of liquid and/or air as achieved by upper ports 142 and lower ports 144 while in operation.

Liquid covering disk elements in this disclosure are often recited using terms such as "top" and "bottom" to better illustrate elements' relative vertical orientation. However, many liquid covering disks according to this disclosure, specifically including liquid covering disks 100, 200, 300, and 400, may be flipped vertically and be capable of substantially the same functionality. This may be particularly useful in windy conditions, in which a liquid covering disk may be flipped unintentionally.

In many examples, the top member and the bottom member are identical, which simplifies manufacturing. For examples, disks 100, 200, 300, and 400 include identical top and bottom members.

Additionally or alternatively, this disclosure specifically contemplates liquid covering disks that may include differing disclosed features on each of its vertical halves, allowing for slightly modified operation based on the vertical orientation of a particular liquid covering disk in operation.

A preferred construction technique is to fabricate each half of the liquid covering disk by means of injection molding techniques. Each molded half is fused together using a hot plate, which allows for a "perfect weld" when working with high-density polyethylene. Other techniques can also be used, such as ultrasonic welding, high frequency welding, friction welding, spin welding, laser welding, hot gas welding, free-hand welding, and the like.

Disk 200 may be constructed by blow molding techniques. Blow molding may be particularly desirable where high speed fabrication is required. Using blow molding techniques, disk 200 can be fabricated in one simple operation, removing the need for welding two halves. In some examples, the ports are drilled into the sidewalls of the disk after it is formed by blow molding.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A disk configured to float on the surface of a body of liquid, comprising:

a top member configured to float substantially above the surface of the body of liquid, a bottom member spaced from the top member and configured to float substantially below the surface of the body of liquid;

a sidewall extending between the top member and the bottom member along the periphery of the top member and along the periphery of the bottom member, wherein the top member, the bottom member, and the sidewall collectively define a cavity;

a chamber mounted within the cavity, the chamber enclosing a predetermined volume of a gas; and a port defined in the sidewall to allow liquid from the body of liquid to enter the cavity;

wherein the predetermined volume of gas enclosed in the chamber is selected to impart a buoyancy force sufficient to maintain the disk afloat on the body of liquid with the bottom member a predetermined depth below the surface of the body of liquid; and wherein the cavity defines a depression in the lower member at a position to distribute liquid within the cavity to facilitate maintaining the disk substantially level relative to the surface of the liquid as the cavity fills with liquid.

2. The disk of claim 1, wherein the predetermined depth of the bottom member below the surface of the body of liquid is selected to be substantially between $1/10^{th}$ and $6/10^{th}$ the distance between the top member and the bottom member to fill the cavity with a predetermined volume of water to resist the tendency of wind to move the disk.

3. The disk of claim 1, wherein the port is defined in the sidewall proximate the bottom member to facilitate liquid entering the cavity.

4. The disk of claim 1, wherein the chamber is sealed to inhibit liquid from entering the chamber.

5. The disk of claim 1, wherein the chamber contains a liquid impermeable material enclosing the predetermined volume of gas.

6. The disk of claim 1, wherein the chamber is mounted substantially at the center of the cavity.

7. The disk of claim 1, wherein the sidewall defines a plurality of ports spaced around the disk.

8. The disk of claim 7, wherein the plurality of ports includes a first set of ports proximate the top member and a second set of ports proximate the bottom member.

9. A disk configured to float on the surface of a body of liquid, comprising:

a top portion including:

a top interior surface, a top periphery all extending transversely from the top interior surface to a top periphery wall terminal end, the top periphery wall defining a top port and extending around the top interior surface to partially enclose a top cavity, a top chamber wall extending transversely from the top interior surface to a top chamber wall terminal end, the top chamber wall extending in a continuous path to partially enclose a top chamber; and a bottom portion including:

a bottom interior surface facing the top interior surface, a bottom periphery wall extending transversely from the bottom interior surface to a bottom periphery wall terminal end, the bottom periphery wall defining a bottom port and extending around the bottom interior surface to partially enclose a bottom cavity, a bottom chamber wall extending transversely from the bottom interior surface to a bottom chamber wall terminal end, the bottom chamber wall extending in a continuous path to partially enclose a bottom chamber;

wherein:

the top periphery wall terminal end aligns with and is attached to the bottom periphery wall terminal end to define a cavity, and the top chamber all terminal end aligns with and is attached to the bottom chamber wall terminal end to define a chamber.

10. The disk of claim 9, wherein the top periphery wall terminal end attaches to the bottom periphery wall terminal end via a welded union of the top periphery all terminal end and the bottom periphery wall terminal end.

11. The disk of claim 9, wherein the top chamber wall terminal end attaches to the bottom chamber wall terminal end via a welded union of the top chamber wall terminal end and the bottom chamber wall terminal end.

12. The disk of claim 9, wherein the top portion and the bottom portion are substantially identical.

13. A disk configured to float on the surface of a body of liquid, comprising:

a top member configured to float substantially above the surface of the body of liquid, a bottom member spaced from the top member and configured to float substantially below the surface of the body of liquid;

a sidewall extending between the top member and the bottom member along the periphery of the top member and along the periphery of the bottom member, wherein the top member, the bottom member, and the sidewall collectively define a cavity;

a chamber mounted within the cavity, the chamber enclosing a predetermined volume of a gas; and a port defined in the sidewall to allow liquid from the body of liquid to enter the cavity;

wherein the predetermined volume of as enclosed in the chamber is selected to impart a buoyancy force sufficient to maintain the disk afloat on the body of liquid with the bottom member a predetermined depth below the surface of the body of liquid;

wherein the chamber is mounted substantially at the center of the cavity; and wherein the cavity includes a groove defined in the lower member surrounding the chamber to distribute liquid around the chamber to facilitate leveling the disk on the surface of the liquid body.

14. A disk configured to float on the surface of a body of liquid, comprising:

a top member configured to float substantially above the surface of the body of liquid, a bottom member spaced from the top member and configured to float substantially below the surface of the body of liquid;

sidewall extending between the top member and the bottom member along the periphery of the top member and along the periphery of the bottom member, wherein the top member, the bottom member, and the sidewall collectively define a cavity;

a chamber mounted within the cavity, the chamber enclosing a predetermined volume of a gas; and a port defined in the sidewall to allow liquid from the body of liquid to enter the cavity;

wherein the predetermined volume of gas enclosed in the chamber is selected to impart a buoyancy force sufficient to maintain the disk afloat on the body of liquid with the bottom member a predetermined depth below the surface of the body of liquid; and wherein the top member defines a protuberance defining a notch partially surrounded by vertically oriented spokes configured to catch the wind.

15. The disk of claim 14, wherein the protuberance extends symmetrically from the center of the top member to opposite sides of the periphery of the top member and slopes downward from the center of the top member to the periphery of the top member.

16. A disk configured to float on the surface of a body of liquid, comprising:

a top member configured to float substantially above the surface of the body of liquid, a bottom member spaced from the top member and configured to float substantially below the surface of the body of liquid;

a sidewall extending between the top member and the bottom member along the periphery of the top member and along the periphery of the bottom member, wherein the top member, the bottom member, and the sidewall collectively define a cavity;

a chamber mounted within the cavity, the chamber enclosing a predetermined volume of a gas; and a port defined in the sidewall to allow liquid from the body of liquid to enter the cavity;

wherein the predetermined volume, of gas enclosed in the chamber is selected to impart a buoyancy force sufficient to maintain the disk afloat on the body of liquid with the bottom member a predetermined depth below the surface of the body of liquid; and wherein the top member defines a depression.

17. A disk configured to float on the surface of a body of liquid, comprising:

a top member configured to float substantially above the surface of the body of liquid, a bottom member spaced from the top member and configured to float substantially below the surface of the body of liquid;

a sidewall extending between the top member and the bottom member along the periphery of the top member and along the periphery of the bottom member, wherein the top member, the bottom member, and the sidewall collectively define a cavity;

a chamber mounted within the cavity, the chamber enclosing a predetermined volume of a gas; and a port defined in the sidewall to allow liquid from the body of liquid to enter the cavity;

wherein the predetermined volume of has enclosed in the chamber is selected to impart a buoyancy force sufficient to maintain the disk afloat on the body of liquid with the bottom member a predetermined depth below the surface of the body of liquid; and wherein the top member acrd bottom member define substantially identical polygons.

* * * * *